United States Patent [19]

Miller

[11] 4,197,898

[45] Apr. 15, 1980

[54] CONTROLLED COOLED MOLD CAR AND METHOD FOR THE ELECTROSLAG REMELTING PROCESS

[75] Inventor: Samuel L. Miller, Honey Brook, Pa.

[73] Assignee: Lukens Steel Company, Coatesville, Pa.

[21] Appl. No.: 935,160

[22] Filed: Aug. 21, 1978

Related U.S. Application Data

[63] Continuation of Ser. No. 729,947, Oct. 6, 1976, abandoned.

[51] Int. Cl.[2] ..... B22D 27/02

[52] U.S. Cl. ..... 164/4; 164/52; 164/154; 164/252

[58] Field of Search ..... 164/4, 154, 52, 252, 164/348

[56] References Cited

U.S. PATENT DOCUMENTS

| | | | |
|---|---|---|---|
| 3,438,424 | 4/1969 | North | 164/348 X |
| 3,502,133 | 3/1970 | Carson | 164/414 X |
| 3,899,017 | 8/1975 | Croft | 164/348 X |

*Primary Examiner*—Robert D. Baldwin

*Attorney, Agent, or Firm*—Mason, Mason and Albright

[57] ABSTRACT

A method and apparatus for controlling the cooling rate at the bottom of molds used in the electroslag remelting process as the ingots solidify therein to provide a slow cooling and eliminate butt cracking in the bottoms of such ingots.

8 Claims, 2 Drawing Figures

CONTROLLED COOLED MOLD CAR AND METHOD FOR THE ELECTROSLAG REMELTING PROCESS

RELATED APPLICATIONS

This is a continuation of application Ser. No. 729,947 filed Oct. 6, 1976, now abandoned.

BACKGROUND OF THE INVENTION

This invention relates to apparatus and a process for cooling the bottom of a mold (usually in practice at the top of the mold car) used in the electroslag remelting (ESR) process. More particularly it relates to a spray cooling of the bottom of ESR molds whereby butt cracking which heretofore existed in the bottoms of ingots produced by the ESR process is eliminated.

The ESR process is used for producing high quality speciality steels and non-ferrous alloys by the fusing of metal from the bottom of a consumable electrode received in a blanket of slag or flux, such metal being refined as it passes through the molten slag or flux. This is generally accomplished by suspending the consumable electrode within a water cooled copper or steel mold with a layer of molten slag disposed in the bottom therein. The slag acts as a conductor for an electric current passing between the consumable electrode and the starter plate or stool which is usually at the bottom of the mold. The mold usually has an open bottom and is supported on the starter plate by a water cooled base which may also be considered part of the operative mold. This base may be the top of a mold supporting car. The process commences when a layer of molten slag is received in the bottom of the mold and the top part of the electrode is received in the molten slag. Current then passing through the electrode and molten slag heats the electrode and droplets of metal fusing off the electrode's lower end fall through the slag to the bottom of the mold where a pool of molten metal forms and solidifies upward from the bottom of the mold thus forming an ingot. A refining action takes place on the molten metal as it passes through the molten slag and, as the electrode is progressively consumed, refined metal builds up from the bottom of the mold to form the ingot. The molten slag floats on the pool of refined metal and remains in contact with the lower end of the consumable electrode with the refining process being continued until the electrode is consumed or substantially consumed.

In the production of steel by the ESR process it has been a usual practice to control the rate of cooling of the molten metal by the circulation of water in the walls of the mold and through the bottom of the mold or mold car as the refined ingots are being formed. Although this practice has been very effective in the production of high quality steel, certain difficulties have been encountered during the initial forming phase of the ingot. One such problem has been the formation of butt cracks appearing in the bottom of the ingots. Also any leakage which might occur from the cooling water could lead to introduction of hydrogen into the ingot and result in hydrogen embrittlement of the ingot steel.

In seeking a solution to the leakage problem, it is the concept of the inventor that adequate cooling might be obtained by a controlled spray system rather than solid fluid cooling. The use of a spray to cool an ESR mold is not new, as such, such being disclosed in a prior art patent to Hopkins U.S. Pat. No. 2,300,670. Also the technique of using a spray for cooling the bottom of an ingot mold is not new, as such, as evidenced by U.S. Pat. No. 1,298,825 of Tebbetts. Other prior art patents involving a spray for cooling molds include the patent to York U.S. Pat. No. 1,551,277, the patent to Leary, U.S. Pat. No. 1,753,380 and the patent to Woodburn, U.S. Pat. No. 3,590,904.

SUMMARY OF THE INVENTION

The invention involves a water spray or spray chilling system applied to the underside of the bottom of the ESR mold through a plurality of horizontal pipes which are fed from a common line and which have a solenoid valve therein for control purposes. Placed on the top of the bottom of the mold (or on the top of the mold car) is a starter plate upon which the open bottomed ESR mold is carried. A thermocouple is placed under the starter plate in the upper surface of the mold in the bottom, the thermocouple being connected through a temperature indicator and valve control to the solenoid valve. Through this means the temperature of the top of the mold car and also of the bottom of the starter plate is controlled within rather close limits. By using a spray instead of a solid stream of water, the chances of leakage of water into the interior of the mold are substantially reduced. An entirely unexpected result obtainable through utilization of the system has been elimination of butt cracks in the bottom of the ingot. Through investigation, it has been determined that both the leaks and the butt cracks resulted primarily from an uneven rate of cooling of the bottoms of the ESR ingots as they were solidifying in the mold. Thus by the provision of a uniform controlled cooling at the bottom of the mold both the problem of leakage of water into the mold and butt cracking of the ESR ingots have been substantially eliminated. Accordingly, a primary advantage of the invention is the provision of means to control the rate of cooling of the ESR ingots as they solidify in the bottom of the molds with the resulting important discovery that the method eliminates butt cracks in that it achieves uniform controlled cooling of the bottom portions of the ESR molds and thus of the ingots formed therein. A further object of the invention is the elimination of leaks in existing ESR mold systems.

Other objects, adaptabilities and capabilities of the invention will appear as the description progresses, reference being had to the accompanying, in which:

DESCRIPTION OF THE PREFERRED EMBODIMENT

Figure 1:
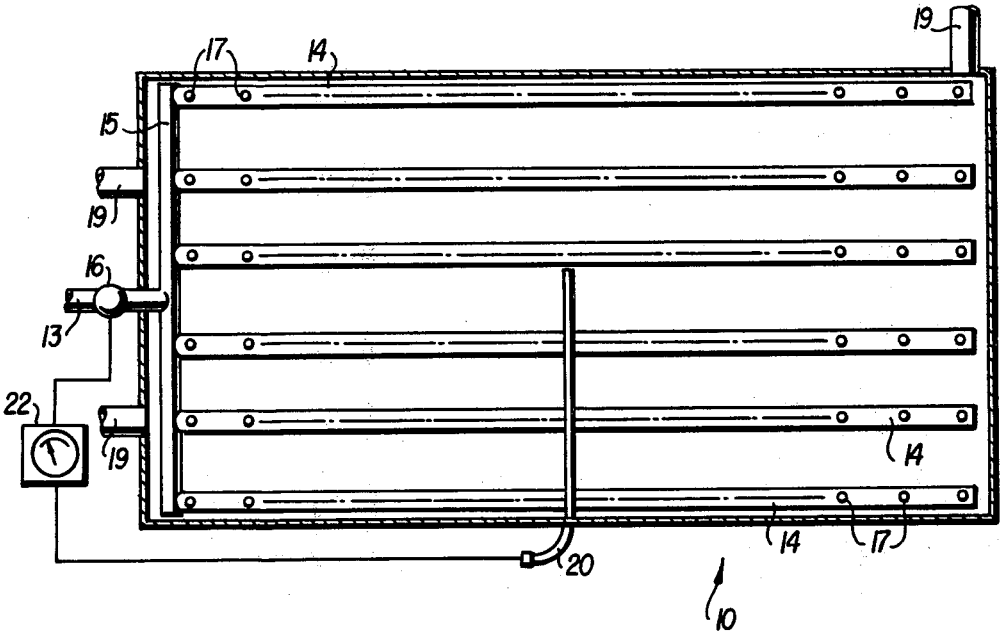
FIG. 1 is a plan view of the mold floor with the top thereof removed to illustrae the arrangement of spray nozzles and thermocouple.

Referring to the drawings, reference numeral 10 generally designates a mold floor which may be part of a car carried on tracks whereby a conventional ESR mold 12 may be positioned under a consumable electrode and subsequently removed therefrom. A steel starter plate 11 is interposed between mold floor 10 and the mold 12. The primary purpose of starter plate 11 is to afford a metal conductor whereby current through slag in mold 12 passes between starter plate 11 and the consumable electrode. Both starter plate 11 and the mold 12 are well known in the art and no further description is considered necessary.

The chilling or cooling system comprises a plurality of conduits 14 interconnected at one end by a transverse pipe 15 which, in turn, is connected to a solenoid valve 16 which controls the flow of water from a fresh water inlet 13.

Each conduit 14 includes a multiplicity of spray nozzles 17 which are of a type and character to produce a spray of conical shape having a dense pattern. If desired, baffles may be placed between conduits 14 extending parallel thereto. The function of the sprays is to cover completely the bottom surface of the top floor plate 21 such plate preferably being composed of copper. The uniform arrangement of nozzles as shown in FIG. 1 provides an even distribution of the chilling water over the entire area of the floor surface of plate 21. Spray water gravitates to the catch pan 18 and is discharged through drains 19 for ultimate disposal, thus completing the cycle. The discharged water may be cooled and recycled or otherwise utilized.

Figure 2:
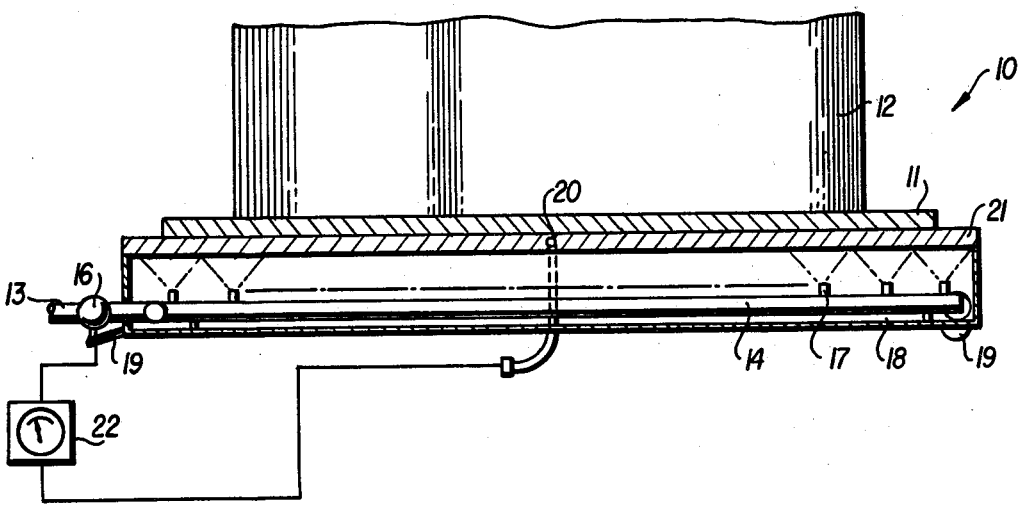
FIG. 2 is a side view of the mold floor including the top thereof, a starter plate, and the lower part of an open bottomed ESR mold received thereon.

An important feature of the invention constitutes the thermocouple 20. As illustrated in FIGS. 1 and 2, thermocouple 20 is disposed in a generally median area relative to plate 11 and adjacent the bottom surface thereof. More particularly, it is positioned under the starter plate 11 and in the top mold plate 21 and is connected through a temperature indicator and valve control 22 to solenoid valve 16. In this position, thermocouple 20 is responsive to the temperature of the slag in the mold 12 and more particularly, to the slag being formed on the top of starter plate 11. Such temperature is transmitted to control 22 which governs actuation of solenoid valve 16. Preferably thermocouple 20 is of an iron-constantan type with the thermocouple wire brought from the underside of the mold floor 10 into a blind hole drilled perpendicularly into the top plate 21. A signal from the thermocouple 20 is amplified by a standard temperature control which, in turn, activates a solenoid valve which is required to keep the temperature of bottom of the mold at about 400 degrees Fahrenheit. Temperature indicator and control 22 includes a dial whereby the operator is informed of the temperature of the probe of thermocouple 20. With this arrangement, it has been found that the temperature of the top plate 21 and also the bottom of starter plate 11 are maintained within desired predetermined limits.

With the above-described arrangement, the cooling rate of the bottom portions of the ESR ingots are controlled within close limits, and, as previously indicated, such control has been found substantially to eliminate leaks and has solved the problem of cracking in the bottom of the ESR ingots.

Although the preferred embodiment of my invention has been described above, it should be understood that the inventive concept includes other adaptations and modifications within the scope of the appended claims which are intended to cover corresponding structure and steps described in the specification and equivalents thereof.

Having thus described my invention, what I claim as new and desire to secure by Letters Patent of the United States is:

1. A method of controlling the temperature at the base of an open bottom ESR mold and preventing the formation of butt cracks in the bottom of an ingot formed in said open bottom ESR mold in the ESR process which comprises the steps of providing a thermo-responsive means immediately adjacent the underside of a starter plate covering the separate mold floor at the base of said mold, said starter plate being completely under said mold whereby the lower edges of said mold are engaged and supported by said plate, the underside of said starter plate being completely engaged and supported by said separate mold floor, reflecting said thermo-response to a fluid-flow control means, and applying said controlled flow fluid in a liquid spray in an even distribution to substantially the entire underside of said mold floor within a confined space provided thereunder whereby said starter plate on said mold floor is uniformly cooled by said spray via conduction from said mold floor, said fluid gravitating from the underside of said separate mold floor and being removed from said space under said mold floor upon having been sprayed against the underside of said separate mold floor.

2. A method in accordance with claim 1, wherein said controlled flow fluid is applied by a multiplicity of sprays of conical shape having a dense pattern to the underside of said separate mold floor.

3. A method of eliminating leaks at the base of an open bottom ESR mold and cracks in the bottoms of steel ingots produced therein, said method comprising the steps of providing molten metal from a consumable steel electrode having its lower end in a blanket of slag, said molten metal received on a starter plate extending completely over said base in said mold and supporting the bottom edge of said mold whereby said starter plate extends outwardly of said mold bottom and said base extends outwardly of said starter plate, maintaining the temperature of said starter plate at substantially a constant temperature of about 400° F. by applying a liquid coolant in an even distribution within a confined space to the entire area of underside of said base in an upwardly directed spray form while continuously providing additional molten metal from said consumable electrode into said mold, said metal on said starter plate of said mold solidifying, and said sprayed coolant gravitating from said underside of said base and thereafter being removed from said confined space, a thermocouple placed under said starter plate and in said base centrally in said mold for controlling the flow of said sprayed coolant.

4. An apparatus for controlling the temperature of the underside of an ESR mold floor and preventing butt cracks from forming in the bottom of ingots produced therein which comprises an ESR open bottom mold, an ESR mold starter plate completely under and supporting said open bottom mold and a base, said starter plate having its underside completely engaged by said base, a thermocouple immediately disposed under said starter plate and in said base, a confined space immediately under said base which extends completely under said starter plate with said base comprising the top of said confined space, liquid fluid spray distribution means below the top of said confined space and within said confined space directed upwardly to spray in an even distribution against the underside of said base whereby it cools uniformly substantially the entire said base underside, means responsive to the temperature reflected by said thermocouple for controlling the rate of fluid introduced into said fluid distribution means, and means for removing said fluid from said confined space following the spraying of same on the underside of said base and after gravitationg from said underside to the bottom of said confined space.

5. An apparatus in accordance with claim 4, wherein said fluid spray distribution means comprises a plurality of interconnected conduits positioned to spray fluid over the entire area of the underside of said base and spray nozzle means on said conduits to direct fluid in dense conically-shaped sprays in the direction of said base's underside.

6. An apparatus in accordance with claim 5, wherein said thermocouple is connected to a temperature indicator and valve control means and said temperature indicator and valve control means is connected to a fluid controlling solenoid valve.

7. An apparatus in accordance with claim 6, wherein said spray nozzle means provides a multiplicity of substantially conical fluid jets diverted against the underside of said base and being adapted to impinge fluid spray on substantially the entire area thereof.

8. An apparatus in accordance with claim 7, wherein said confined space comprises catch means disposed beneath said conduits for accumulating spent fluid gravitating from the underside of said base for recycling or discharge.

* * * * *